US005749342A

United States Patent [19]

Chao

[11] Patent Number: 5,749,342

[45] Date of Patent: May 12, 1998

[54] MOVEABLE APERTURE FOR ALTERATION OF INTAKE MANIFOLD CROSS SECTIONAL AREA

[76] Inventor: Raymond Chao, 619 N. Jimenez La., Placentia, Calif. 92670

[21] Appl. No.: 711,326

[22] Filed: Sep. 3, 1996

[51] Int. Cl.[6] ..... F02M 39/00

[52] U.S. Cl. ..... 123/184.56

[58] Field of Search ..... 123/184.56, 184.21; 251/61; 137/849

[56] References Cited

U.S. PATENT DOCUMENTS

| | | | |
|---|---|---|---|
| 3,875,918 | 4/1975 | Loynd | 123/184.56 |
| 4,858,567 | 8/1989 | Knapp | 123/184.56 |
| 4,928,638 | 5/1990 | Overbeck | 123/184.56 |
| 5,216,985 | 6/1993 | Brummer | 123/184.56 |
| 5,584,270 | 12/1996 | Dohring | 123/184.56 |

*Primary Examiner*—Marguerite McMahon
*Attorney, Agent, or Firm*—Donn K. Harms

[57] ABSTRACT

A device for the passive variation of a fluid stream characteristics of an air fluid stream entering an engine featuring body having an interior cavity which communicates with an intake aperture an outlet aperture located upon the body portion and defines a fluid stream passageway through the body. The outlet aperture cross sectional area is adjusted by vanes formed by a plurality of slits at an inward curve in the wall having a calculated bias toward the center axis point of the outlet aperture. The cross sectional area of the outlet aperture formed by the biased vanes varies from a smaller area when the volume of air fluid stream therethrough is low to a larger area when the volume of the air fluid stream is increased sufficiently wherein the force thereof overcomes calculated bias of the inward biased vanes optimizing the air fluid flow intake into an internal combustion engine.

9 Claims, 4 Drawing Sheets

MOVEABLE APERTURE FOR ALTERATION OF INTAKE MANIFOLD CROSS SECTIONAL AREA

BACKGROUND OF THE INVENTION

1. Field of the Invention

This invention relates to a fluid flow aperture for intake manifolds and communicating chambers. More particularly it relates to a low cost, easily manufactured, and easily installed aperture adjustment device for the variation of fluid flow of an intake manifold or intake chambers for internal combustion engines with the additional benefit of anti reversionary characteristics as well as condensation of the air flow therethrough.

2. Prior Art

A favorite hobby of many persons about the globe and the subject of a constant quest to achieve better performance by engineers, manufacturers, mechanics, and auto hobbyists, is increasing the performance of the internal combustion engine. Whether it be the hot rod being built by the dedicated mechanic or the state of the art production engine being produced by a multi national automotive manufacturer, all seek the same goal. That quest being, more horsepower, better throttle response, and more torque, across a wider range of engine speeds, from the internal combustion engine, which powers the vast majority of automotive products on the road today.

However, as every mechanic as well as professional design engineer knows, improvements in the area of torque, throttle response, horsepower, and general performance of automotive engines usually requires a major mechanical undertaking. Such efforts can entail disassembling and assembling the entire engine, or major parts thereof, as well as the purchase of expensive specialty parts, all to achieve even a small percentage of an increase in performance characteristics.

One such performance increase actively sought by all racing activists as well as automotive manufacturers is an increase in the torque output of internal combustion engines across a wide performance range of such engines. The focus of such engineering endeavors often centers upon the intake manifolds, chambers, and passages supplying air and fuel mixtures to the cylinders of internal combustion engines.

Conventional intake manifolds and intake fluid passages produce torque peaks only in the low or high speed ranges of the engine. Consequently, more torque peaks are desirable to generate greater output from internal combustion engines across a wider range of rotational speeds of such engines.

Such torque increases have and can be altered and increased by the alteration of the cross sectional area of the intake passages of internal combustion engines. Desirable changes in the velocity and rate of oscillation of the fuel and air flow into an internal combustion engine are influenced by such alterations of the area of intake passages. Such modifications to allow alteration of intake passages with dependance upon engine speed, to be useful in production autos as well as racing autos, need to be easily installed, easily serviced, and simple in operation. Intake passage cross section altering devices should also exhibit characteristics of functional reliability over a long lifetime and be easily replaceable. The alteration of intake passage area and benefits therefrom has been taught in prior art in a number of fashions.

U.S. Pat. No. 5,216,985 (Brummer et. al. ) teaches an intake manifold for an internal combustion engine which has an elastically expandable membrane disposed inside an intake manifold interior fluid passage. The cross sectional area of the passage is decreased by inflating the membrane and increased by deflating the membrane. The inflation and deflation of the elastic membrane require a pump and control therefor which actively alters the passageway. Consequently, Brummer is not easily installed on older engines without significant mechanical modifications and is subject to a breakdown if the control of the membrane malfunctions. It would also require expensive controls and be subject to a breakdown and or malfunction.

U.S. Pat. No. 5,076,218 (Graziadei) teaches an apparatus for a two-cycle engine for alteration of air flow into a cylinder subsequent to passing through the carburetor and carburetor manifold. Graziadi unfortunately teaches mechanical removal of the carburetor from the cylinder heads and replacement of the intake manifold. It is also being manufactured from multiple parts increasing cost and does not achieve fluid velocity optimization by alteration of the cross sectional area of the intake port based upon engine speed requirements.

U.S. Pat. No. 4,858,567 (Knapp) teaches a spring biased rectangular twist flap which alters the cross sectional area of intake passages. However the flap is not easily installed on existing engines already on the road and subjects incoming air flow to deviation to one side of the chamber rather than focusing such airflow down the center of the chamber. Additional the spring biasing mechanism, should it malfunction or come loose, could damage the engine if it were sucked into a chamber.

U.S. Pat. No. 5,016,856 (Tartanglino) teaches an inflatable bladder for control of fluid flow. All embodiments taught by Tartanglino however require an inflation means for the bladder along with a control device for the inflation means. Moreover the fluid flow is generally deflected to one side of the fluid channel by the bladder and subject to increased turbulence. Tartanglino is thus not easily installed in existing engines or newly constructed engines without extensive modification and requires active inflation and deflation of the bladder for the reduction of fluid flow cross sectional area. It would also be expensive to manufacture for different engines as it is not designed for internal combustion engines.

As such, there exists a need for an easily and inexpensively manufactured device for the alteration of intake manifold chamber cross sectional area to produce optimum flow characteristics in the air fluid stream feeding and internal combustion engine. A need further exists for such a device that is easily installed upon existing engines as well as newly manufactured engines and which does not require a control for activation of the device. There exists a further need for such a device which enhances the fluid flow characteristics without redirecting the flow against the sides of the intake chambers while offering the concurrent benefit of imparting an anti reversionary enhancement of the fluid flow therethrough. An added need exists for such a device which would be easily adaptable to a multitude of existing and newly manufactured engines off of a base design platform.

SUMMARY OF THE INVENTION

Applicant's device is easily manufactured from conventional plastic or metal materials. The inwardly curved body shape with slits form an outlet aperture portion of the preferred embodiment of the device additionally imparts an anti reversionary characteristic to fluid flowing through the device concurrently allowing for easy adaptation of the device to different engines by varying the length and stiffness of the individual aperture reeds.

In use the device can be easily inserted into the air fluid stream entering an internal combustion engine by insertion into the conduit feeding the carburetor or throttle plate injector, or by insertion into the passageways feeding the cylinders.

The device can be made of plastic such as polyethylene, polyporpylene, polyurethene, or other conventional plastics used where heat and fuel and oils are present in automobiles or mixtures thereof. In high heat situations should a suitable conventional plastic not be advisable conventional metal materials used for engine manufacture such as copper, aluminum, steel, titanium, brass or mixtures thereof can be used.

The device is easily manufactured by injection or other types of molding or by machining it or by combinations of molding and machining to final desired size, shape, and bias characteristics.

In summary, the present invention is an improvement over intake manifold cross sectional area altering devices now in use and known in prior art. It is novel and satisfies a long unmet need for an easily and inexpensively manufactured combination aperture for cross sectional area alteration of intake manifolds and chambers while affording the added benefit of inducing anti reversionary flow characteristics into the fluid flow. It is also easy to manufacture, install in new and existing engines, and each to adapt to different engine fluid flow requirements for maximum torque and performance peaks.

The preferred current embodiment of the invention features a cylindrical shaped device having an intake aperture on one end and an outlet aperture formed by an inward curve of the outside diameter of the cylindrical shaped device at the distal. The outlet aperture is adjustable in cross sectional area by slits in the curved portion forming vanes which and a natural bias toward the center of the cylinder forming the invention. The vanes bias can be calculated on an engine by engine basis to yield the optimum desired intake fluid flow characteristics. The device would be easily manufactured by molding or machining or combinations thereof depending upon whether plastic or thin metal were used to form it.

An object of this invention is providing a passive aperture which alters the cross sectional area available of a tube or chamber providing fluid flow of air or air and fuel mixtures to internal combustion engines in a manner to produce maximum torque and engine response across a wide range of engine speeds.

Another object of this invention is to provide the additional benefit of anti reversionary fluid flow characteristics imparted by the inwardly curved shape of the body of the invention at the outlet aperture at the larger cross sectional channel providing fluid flow of air or an air fuel mixture to internal combustion engines.

A further object of this invention is to provide users with an easily installed after-market device which can be quickly and easily installed in the fluid intake channel feeding air fluid flow to a carburetor or throttle body fuel injector, or manifold feeding air to a fuel injected system.

A further object of this invention is to provide the aforementioned benefits in an easily and cheaply manufactured device which is easily adaptable to a wide range of engines by simple variation of the outside diameters of the device to fit to be accepted by the inside diameter or the intended intake chamber.

A further object of this invention is to achieve the aforementioned cross sectional intake chamber alteration and anti reversionary fluid flow characteristics using a device which can be easily manufactured as once piece devices of unitary construction or if desired in multiple parts.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
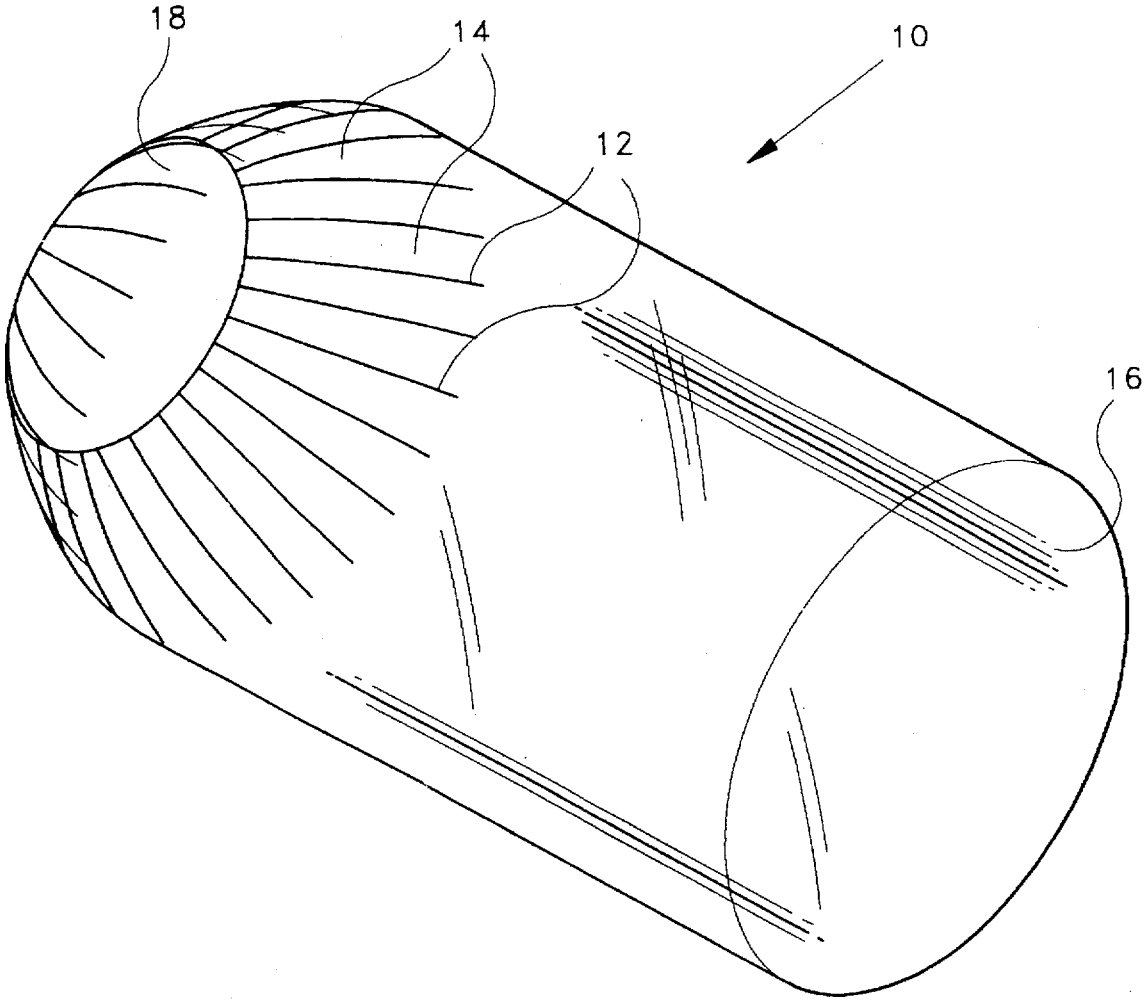
FIG. 1 is a perspective view of the cylindrical fluid flow aperture device showing the nose portion with exit aperture area.

Referring now to the drawing Figures, specifically FIG. 1 depicts the preferred embodiment of the invention in a perspective view of the cylindrical fluid flow aperture device 10 showing the nose portion 13 with slits 12 in the wall of the body of the device and in communication with the area of the outlet aperture 18 defining flexibly individually separable vanes 14. The material used to manufacture the device for use in colder areas of an engine would be plastic or some other synthetic and could be injection molded or manufactured using other conventional manufacturing procedures. Of course such materials would need to be resistant to the fuel used in the engine on which they are installed.

In hotter areas of an engine, such as close to the intake port of a cylinder head, the plastic used would have to be able to withstand the heat during engine use as well as the temperature changes which occur from a cold start to regular operating temperatures and back again. Whether the material is synthetic plastic or thin walled copper, aluminum, or titanium, it must be of a thickness to provide the required spring or bias of the individual vanes 14 such that those vanes 14 form the desired sized outlet aperture 18 to produce the desired fluid flow through the device during different rpm operation of the engine. Different materials for manufacture of the device would be dependent upon where in the fluid stream the device is positioned with regard to heat and amount of force in that position which is provided by the intake of the internal combustion engine.

The velocity of a fluid stream in a pipe is proportional to the radius of the pipe to the fourth power and to the pressure differential between the two ends of the pipe.

The rate of flow of a fluid through a pipe is proportional to the pressure differential between the two ends of the pipe. The velocity of the fluid in a pipe is inversely proportional to the cross sectional area of the pipe given the same rate of flow through the pipe.

In operation at lower rpm speeds or idle speeds of the attached engine, the device would be subjected to less vacuum force by the intake cycle of the engine since there would be fewer intake cycles by the pistons of the engine. The result being that the vanes 14 located upon the nose portion 13 of the invention, depending on the thickness and material used, would have a natural bias inward to form a smaller outlet aperture 18 in cross sectional area than that of the cross sectional area of the inlet aperture 16.

Since lower revolutions per minute (rpm) operation, create less vacuum force due to fewer intake cycles of the cylinders of the engine. Therefor the rate of flow of air or gas against the sides of the device is lower. The result being that the vanes 14 located upon the inwardly curved portion 13 of the invention, depending upon the biasing force of the vanes toward the center access of the device 10, would form a smaller outlet aperture 18 in cross sectional area of the inlet aperture 16. The smaller cross sectional area of the outlet aperture 18 will thus increase the velocity of the air exiting the device 10 at the exit aperture side.

The bias of the vanes 14 toward the center axis of the outlet aperture 18 can be adjusted prior during manufacture to the individual engine characteristics to achieve the desired performance increase. In the case of a round shaped device the center axis of the inlet aperture 16, the outlet aperture 18 and the airstream passageway( ) communicating with both apertures formed by the hollow interior ( ) of the device 10 would have a common center axis. In the case of an oval or other body shape of the conduit feeding the airstream to an engine the device 10 can be shaped to accommodate a removable or permanent mounting inside of an intake fluid stream conduit feeding an engine. In the case of such custom shapes, the apertures would vary in shape as to the body to fit the conduit but the vanes 14 formed at the outlet aperture 18 would still yield a smaller cross sectional outlet aperture 18 which would increase in size as air flow increases no matter what the vanes 14 shapes. A change of material thickness or the material itself would yield a different natural bias of the vanes 14 toward the center axis of the device 10 to yield the desired adjustment to fluid velocity and flow requirements at given rpm's of the engine.

The optimum bias to produce the desired fluid stream velocity and volume characteristics can be determined on an engine by engine basis by using a number of criteria including but not limited to the total engine displacement, the position of the device 10 in the fluid stream draw in into the engine, the optimum rpm of the engine, the gearing of the vehicle, the fuel mixture, and other engine criteria. Running the vehicle or engine on a dynamometer would be the best initial manner of determination of optimum device 10 bias characteristics for specific engines and vehicles. Once that is determined, the device 10 can be mass produced to yield the desired air stream flow characteristics and sized to fit the fluid stream conduit at the location desired in similar vehicles to that tested.

Since conventional intake manifolds must be constructed to also handle the engine air intake requirements at high rpm's where a higher rate of flow of air is needed for combustion, in low rpm situations, the air speed in the intake manifold or pipes feeding the intake manifold, slows down due to the lower force exerted by the engine intake stroke on the larger cross sectional area of the pipe or conduit feeding the air stream to the cylinders.

Figure 2:
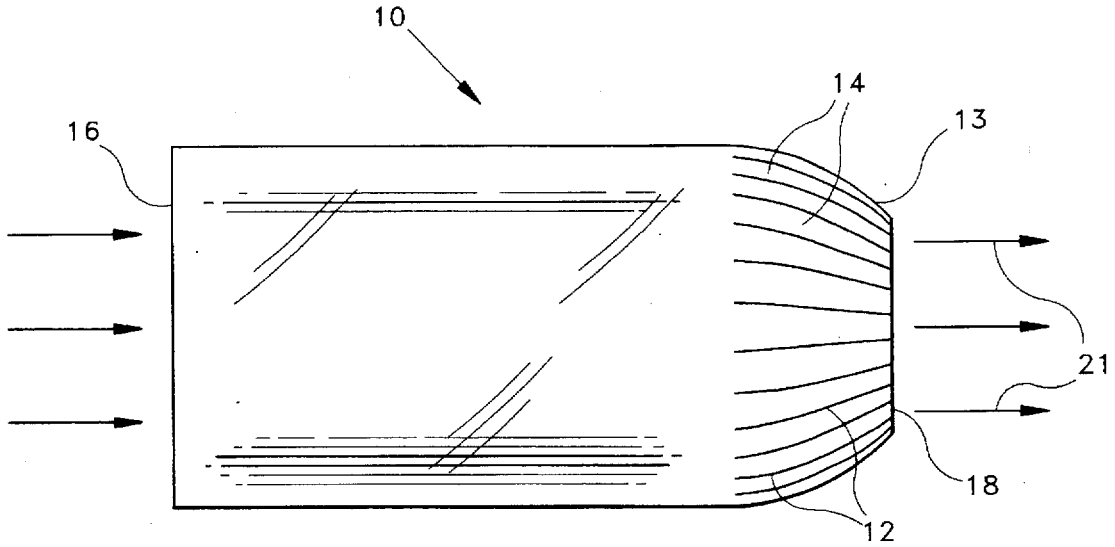
FIG. 2 is a side view of the cylindrical sapped embodiment of the fluid flow aperture device showing the fluid flow entering at the inlet aperture and exiting at the outlet aperture in a reconfigured state.

As shown in FIG. 2 during low rpms of the attached engine, the inward bias of the individual vanes 14 at the nose portion 13 of the device 10 defines a smaller cross sectional area of the pipe or conduit for the flow of air fluid to the engine. The result being that air fluids stream entering through the larger intake aperture 16 speeds up as it exits the outlet aperture 18. This results in more torque and usable horsepower to the attached engine at lower rpm due to the optimization of the air stream characteristics for differing requirements of the engine.

When the engine is at a high rpm, the action of the high speed of the cylinders of the engine during their intake cycle combine to increase the available force to pull an air stream into the communicating intake manifold.

Figure 3:
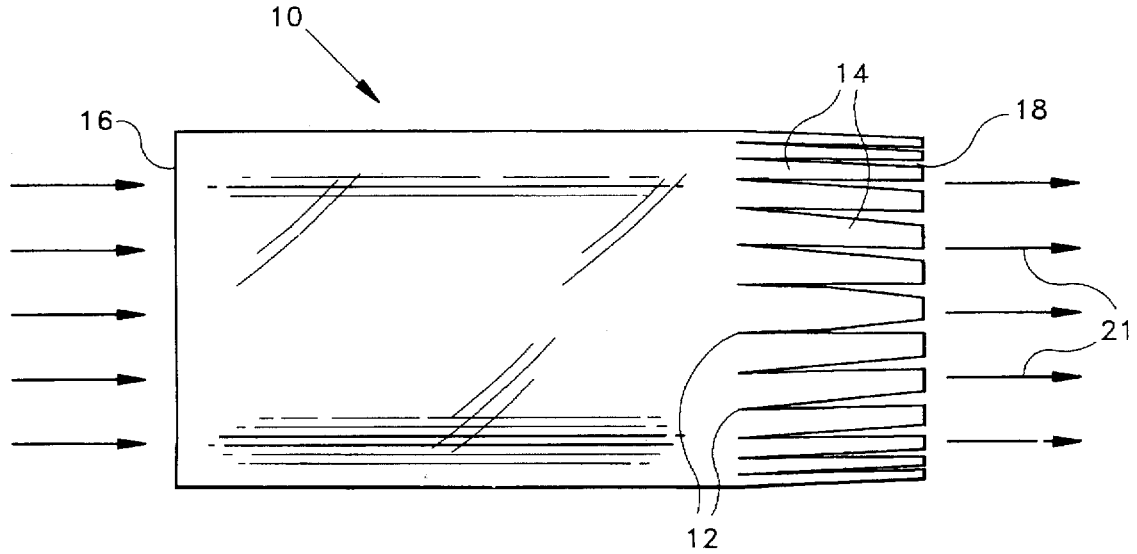
FIG. 3 is a second side view of the cylindrical sapped embodiment of the fluid flow aperture device showing a fluid stream entering the inlet aperture and exiting at the outlet aperture which is in a dilated position.

FIG. 3 depicts the cylindrical fluid flow aperture device during high speed operation where the force of the intake stroke of the engine is sufficient to take the larger volume of air fluid stream entering the device at the inlet aperture 16 and force the vanes 14 toward the outside diameter of the device 10 such that the exit aperture 18 increases in cross sectional area sufficient to accommodate the stream of air required in high rpm situations. As noted earlier, by changing the thickness of the material used in the vanes 14, or the material itself, the bias of the vanes 14 inward toward the center axis of the cylindrical sapped device 10 can be adjusted on a case by case basis. Such a material and thickness adjustment would take into consideration the mixture of fuel and air required by the engine, the force of the intake stroke of the engine at various rpm's, to provide the optimum sized cross sectional area for the intake stroke of the engine at all engine speeds. This of course increases torque and useable horsepower of the engine across the range of rpms.

Figure 4:
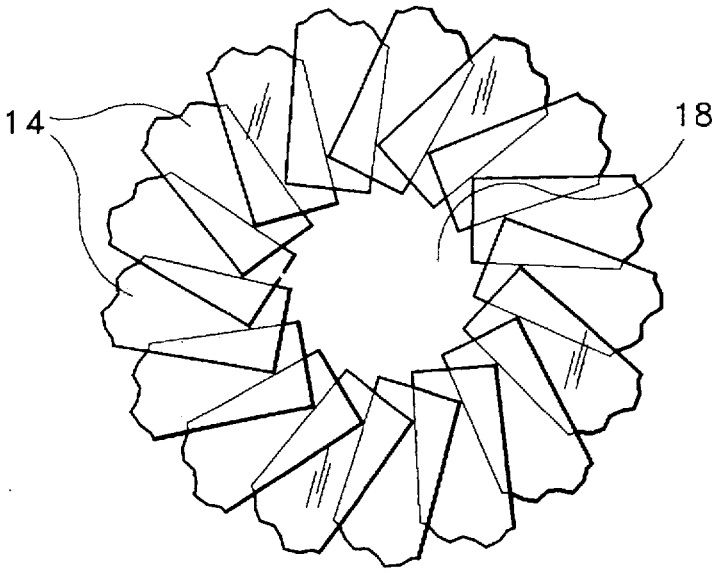
FIG. 4 depicts a different or overlapped configuration of the vanes forming a smaller outlet aperture.

FIG. 4 depicts a different shape for the vanes 14 at the nose portion 13 of the invention 10. The vanes 14 in this embodiment have a cross over at a point where they define the outlet aperture 18 thus decreasing the cross sectional radius thereof. Such a configuration could be used where additional reduction of the cross sectional area of the outlet aperture 18 and thus the pipe or conduit feeding the attached engine, is desired at low and mid range rpms.

The fluid flow aperture device 10 may be placed in the conduit in front of the air stream entering a conventional air filter of throttle body fuel injection system or behind the throttle body itself and in the air stream feeding the individual cylinder intake valves. The easiest position to place the device is obviously in the conduit feeding a conventional throttle body carburetor where significate gains in low and mid range torque and horsepower are achieved. Because of the cooler operational characteristics of this engine area plastics, such as polyethylene, polypropylene, neoprene, vinyl, or similar copolymer plastics, can be used for the device 10 manufacture.

As the device 10 is placed closer to the intake chamber of the cylinder of the engine, its ability to adjust the optimum air flow 21 directly to the cylinder increases, however generally, so does the heat affecting the air flow and the device 10 itself. Consequently, the materials from which the device 10 is manufactured must be adjusted to handle the heat and air flow requirements in the area of the engine in which it is placed. A unitary construction of one type of material would be the easiest manner of manufacture either by injection molding or a combination of molding and slitting. However, multiple manufacture may also be used where the nose portion 13 is made from one material and the rear portion 17 made from another depending on the shape of both as well as the air flow requirements of the engine at the location as well as the heat or if conventional manufacturing techniques or location requirements dictate a multiple piece construction.

Figure 5:
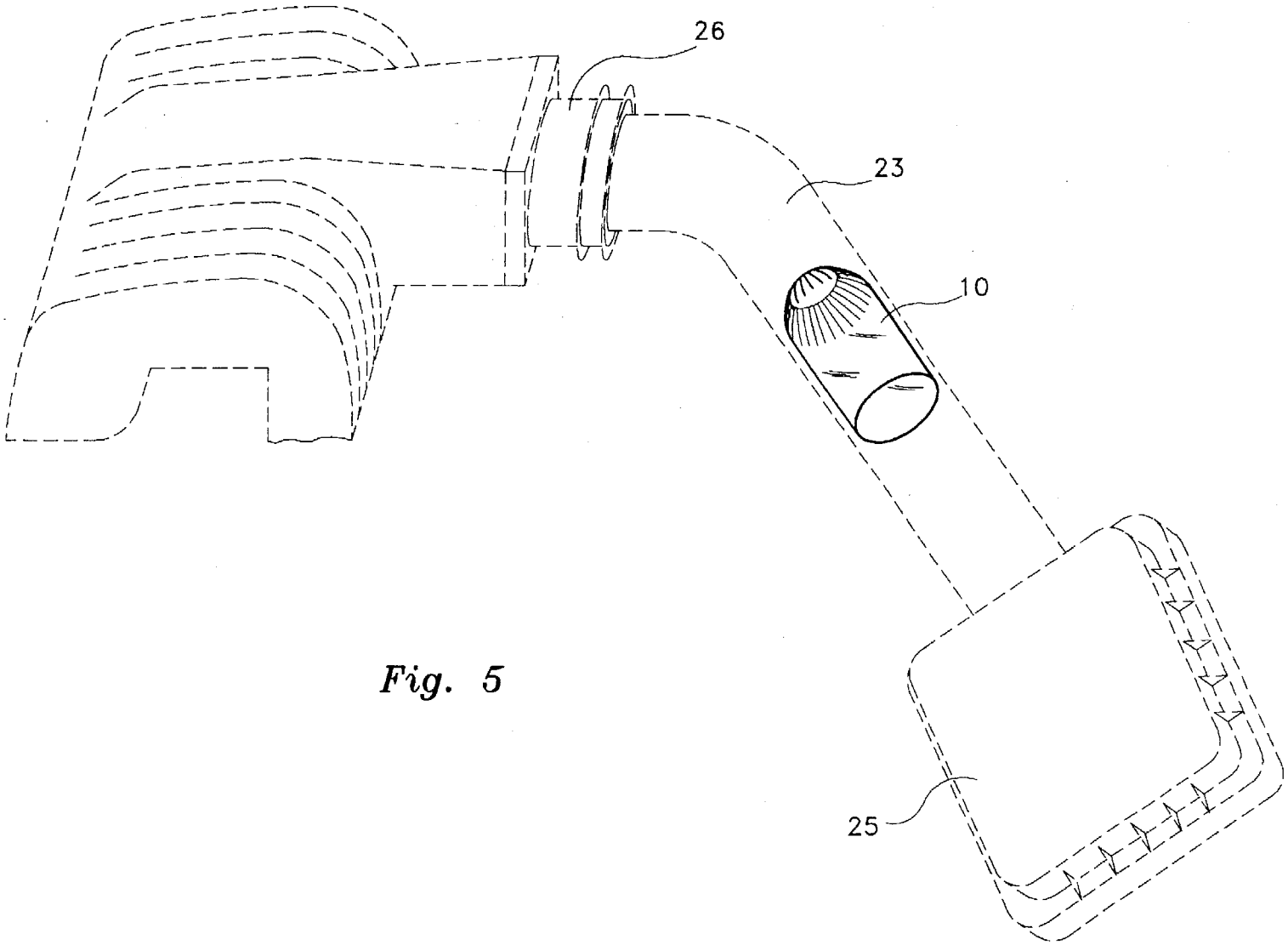
FIG. 5 is a perspective view showing the device as it may be inserted in line in an intake manifold with the inlet aperture end positioned to receive incoming air and with the variable outlet aperture formed by flexible vanes which are inwardly biased towards the center axis of the device.

FIG. 5 shows the device the fluid flow aperture device 10 mounted inside a conventional intake manifold conduit 23 in between the air filter 25 and the throttle body injector 26. However the fluid flow aperture device 10 could be mounted behind the throttle body 26 or carburetor, over even in the individual fluid flow conduits in the cylinder head adjacent to the intake valves feeding individual cylinders an air stream.

Figure 6:
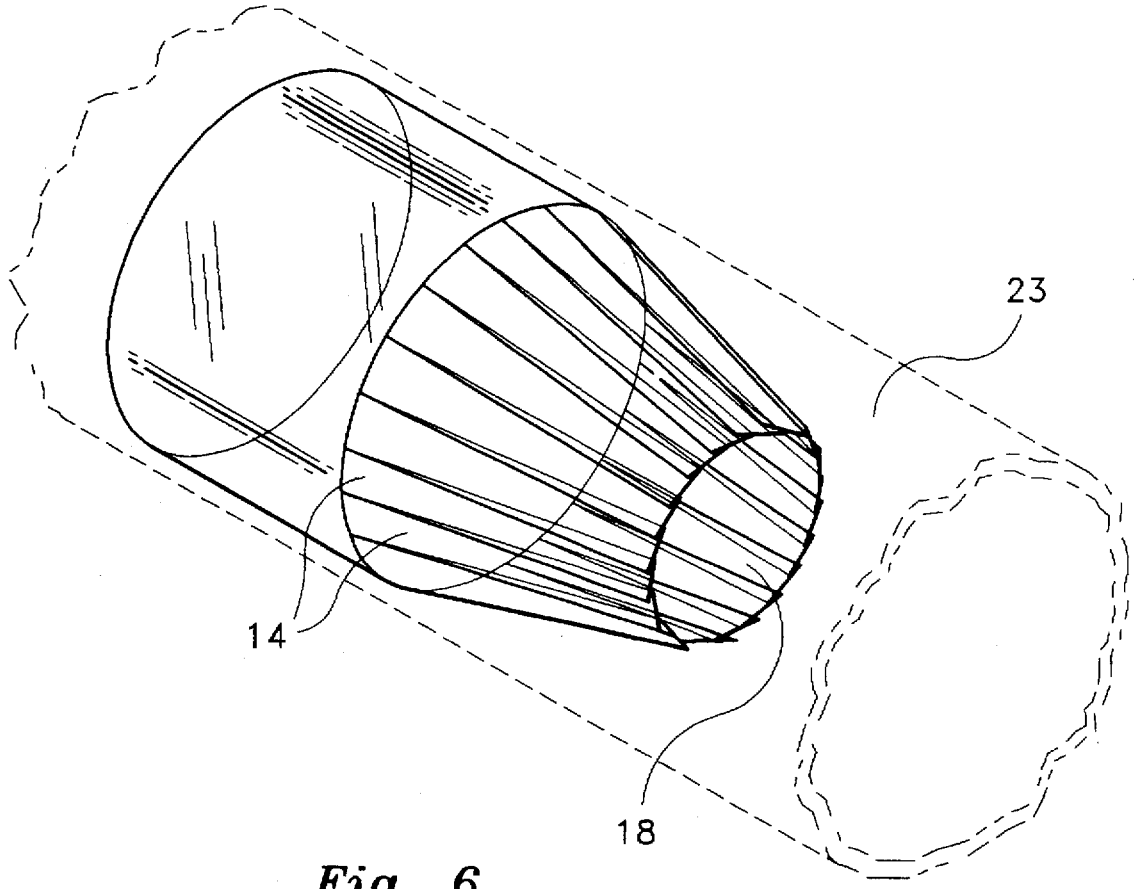
FIG. 6 is a side view showing the device formed as part of the wall of an intake manifold with the flexible vanes angling inward toward the center axis from their connection point upon the interior wall of the manifold forming the variable outlet aperture at the distal end of the vanes.

FIG. 6 shows the fluid flow aperture device 10 formed by mounting or forming the vanes 14 inside the intake manifold air stream conduit 23. The vanes in such an embodiment could be formed as part of the wall of the intake manifold or air stream conduit 23 by molding them in a unitary construction with the section of the manifold or the vanes could be mounted to the interior wall of the intake manifold 23. In either case the vanes would be mounted or formed in a fashion to yield a the same air stream alteration characteristics as mounting the entire aperture device 10 in the intake manifold 23. This embodiment would work best for an original equipment manufacturer since the manifold parts could be designed and manufactured to include the vanes on the interior of the manifold thus eliminating the necessity for a body portion since the manifold would serve that function. In the case of metal intake manifolds the vanes 14 could be mounted and made from flexible plastic material or flexible metal material suitable to yield the desired air stream alteration characteristics. Of course the use of plastic type materials or metal materials is dependent upon the temperatures at the location of the vanes and whether a plastic type material will hold up in the temperature in that area. Metal or some other temperature resistant material with flex characteristics sufficient to yield the desired fluid flow changes would be used for the vanes where temperatures exceed the melting or softening point of plastic or synthetic materials.

While all of the fundamental characteristics and features of the aperture for alteration of the cross sectional area of an intake manifold or chamber invention have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A device for the passive variation of an air fluid stream entering an engine comprising:

a body having an exterior wall and an interior wall said interior wall defining an interior cavity;

an intake aperture at a first end of said body;

an outlet aperture at a second end of said body said outlet aperture having a center axis point;

said interior cavity of said body communicating with said intake aperture and said outlet aperture defining a fluid stream passageway through said body;

an outlet aperture area adjustment means whereby the area of said outlet aperture varies to produce desired fluid stream characteristics therethrough, said outlet aperture adjustment means comprising: an inward curve in the wall of said body at said second end of said body toward said center axis point of said outlet aperture; a plurality of slits in the wall of said body along said inward curve of said wall of said body, said slits defining flexible vanes; said vanes having a calculated bias towards the center axis point of said outlet aperture whereby the cross sectional area of said outlet aperture varies from a smaller area to a larger area to produce said desired fluid stream characteristics through said outlet aperture.

2. The invention as defined in claim 1 having wherein the shape of said body is substantially round in shape and of a diameter wherein said exterior wall of said body is removably mountable to the inside of a substantially round intake manifold of an internal combustion engine.

3. The invention as defined in claim 1 having wherein the shape of said body is substantially round and of a diameter wherein said exterior wall of said body is permanently mountable to the inside of an intake manifold of an internal combustion engine.

4. The invention as defined in claim 1 wherein the shape of said body is formed in a manner that the outside wall of said body frictionally contacts an inside wall of a conduit for the air stream being supplied to an internal combustion engine.

5. The invention as defined in claim 1 in a unitary construction.

6. The invention as defined in claim 5 comprised of plastic, polyurethene, polypropylene, polyethylene, or mixtures thereof.

7. The invention as defined in claim 5 comprised of metal from a group consisting of copper, aluminum, steel, titanium, brass or mixtures thereof.

8. The invention in claim 1 formed in a unitary construction with a portion of the intake manifold of an internal combustion engine.

9. The invention as defined in claim 1 wherein the body of the invention is the a portion of the intake manifold of an internal combustion engine and said vanes are mounted upon an inner wall of the intake manifold in an operable fashion.

* * * * *